US006712294B1

(12) United States Patent
Wang

(10) Patent No.: US 6,712,294 B1
(45) Date of Patent: Mar. 30, 2004

(54) REVOLVING MECHANISM OF A SPRAY HEAD OF A GARDENING SPRINKLER

(76) Inventor: Hsin-Fa Wang, No. 68, Mou Tan Lane, Shao An Li, Lu Kang town, Chang Hua Hsien (TW)

( * ) Notice: Subject to any disclaimer, the term of this patent is extended or adjusted under 35 U.S.C. 154(b) by 0 days.

(21) Appl. No.: 10/439,375

(22) Filed: May 16, 2003

(51) Int. Cl.[7] ..... B05B 7/02

(52) U.S. Cl. ..... 239/525; 239/526; 239/587.5; 285/185; 285/272

(58) Field of Search ..... 239/525, 526, 239/140, 587.1, 587.5, 587.6, 588, 390, 391, 393, 394; 285/122, 123, 184, 185, 273, 275, 279, 272, 276, 282, 319

(56) References Cited

U.S. PATENT DOCUMENTS 2,857,201 A * 10/1958 Palmer ..... 239/587.5
3,893,630 A * 7/1975 Bochmann et al. ..... 239/587.1
6,425,149 B1 * 7/2002 Wang ..... 285/184
6,511,001 B1 * 1/2003 Huang ..... 239/587.1
6,540,159 B1 * 4/2003 Wang ..... 239/526
6,540,163 B1 * 4/2003 Huang ..... 239/587.1

* cited by examiner

*Primary Examiner*—Dinh Q. Nguyen
(74) *Attorney, Agent, or Firm*—Harrison & Egbert

(57) ABSTRACT

A gardening sprinkler includes a main body and a rotary spray head fastened to one end of the main body by a revolving mechanism having a pivoting base and a pivoting body. The pivoting base is extended from the one end of the main body and is provided with an elastic locating body. The pivoting body is fastened to the spray head and is provided with an arcuate rack, which is engaged with the elastic locating body of the pivoting base. As the pivoting body is turned on a pivot of the pivoting base, the elastic locating body moves from one gullet to another of the arcuate rack.

2 Claims, 7 Drawing Sheets

REVOLVING MECHANISM OF A SPRAY HEAD OF A GARDENING SPRINKLER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a gardening sprinkler, and more particular to a mechanism to work the rotation of the spray head of the gardening sprinkler.

BACKGROUND OF THE INVENTION

The conventional gardening sprinkler comprises a main body and a spray head which is rotatably fastened with one end of the main body by a mechanism comprising a plurality of locating holes and a locating device. The locating holes are disposed in a pivoting end of the spray head. The locating device is disposed in the one end of the main body and is formed of a retaining hole, a plunger steel ball, and a spring. The plunger steel ball and the spring are disposed in the retaining hole such that the plunger steel ball is urged by the spring, and that the plunger steel ball is partially jutted out of the open end of the retaining hole. The one end of the main body is provided with a projection acting as a pivot on which the spray head turns. As the spray head is turned in relation to the main body, the plunger steel ball moves into one of the locating holes of the pivoting end of the spray head, so as to locate the spray head at a desired angle. However, the spray head can not be securely located at the desired angle by a joint effort of the locating hole and the plunger steel ball, due to the fact that the joint effort fails to provide a locating force strong enough to locate securely the spray head. As a result, the spray head is vulnerable to dislocation by impact of the water pressure or external force.

BRIEF SUMMARY OF THE INVENTION

The primary objective of the present invention is to provide a gardening sprinkler with a revolving mechanism capable of locating securely a spray head of the gardening sprinkler.

In keeping with the principle of the present invention, the foregoing objective of the present invention is attained by a revolving mechanism comprising an arcuate rack and an elastic locating piece. The arcuate rack is disposed in a pivoting body which is fastened with a connection end of the spray head. The elastic locating piece is secured to a fastening end of a main body of the gardening sprinkler. As the pivoting body is turned on a projecting of the fastening end of the main body, the elastic locating piece plunges into one of the gullets of the arcuate rack so as to locate securely the spray head at a desired position.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
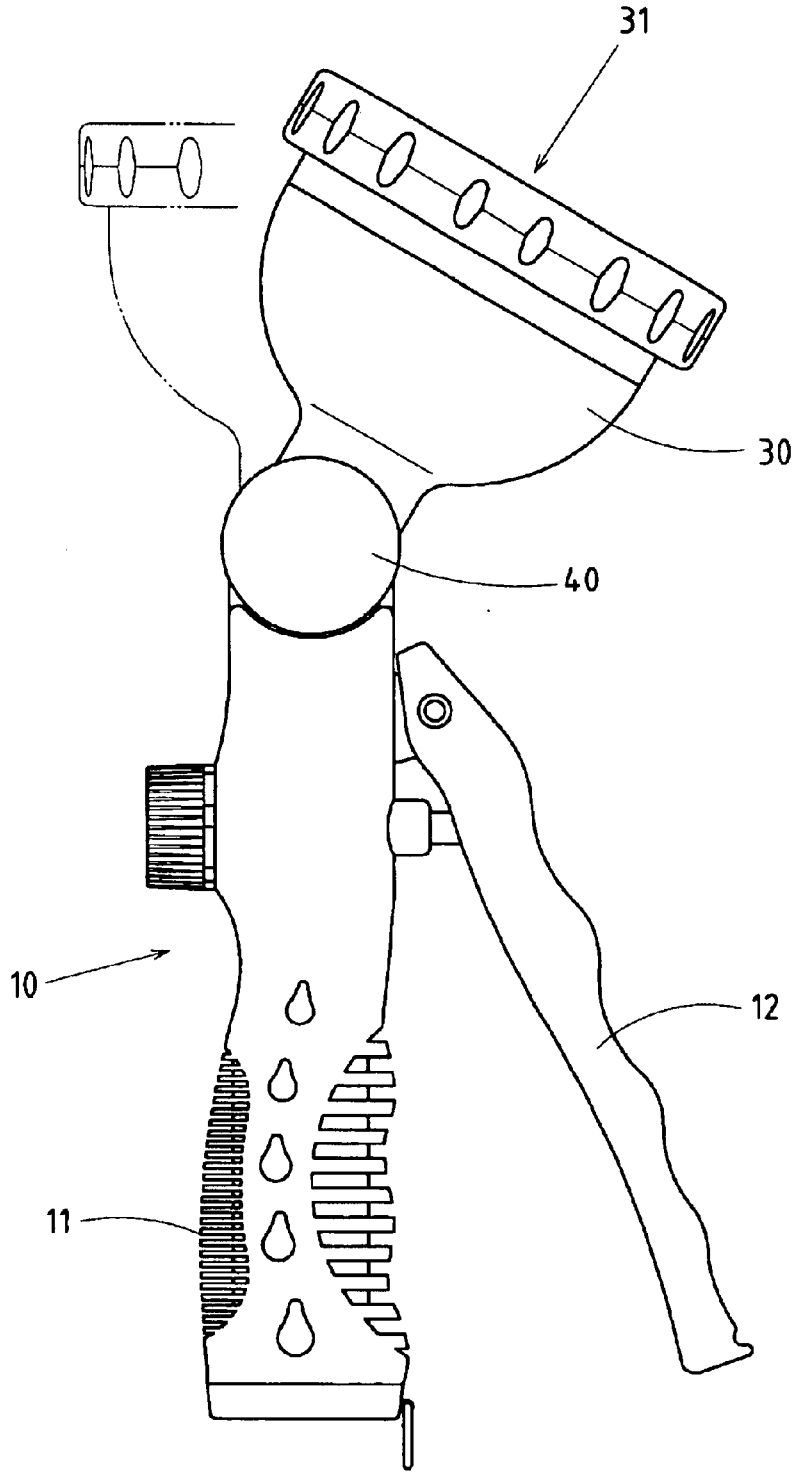
FIG. 1 shows a perspective view of a gardening sprinkler of the preferred embodiment of the present invention.
Figure 2:
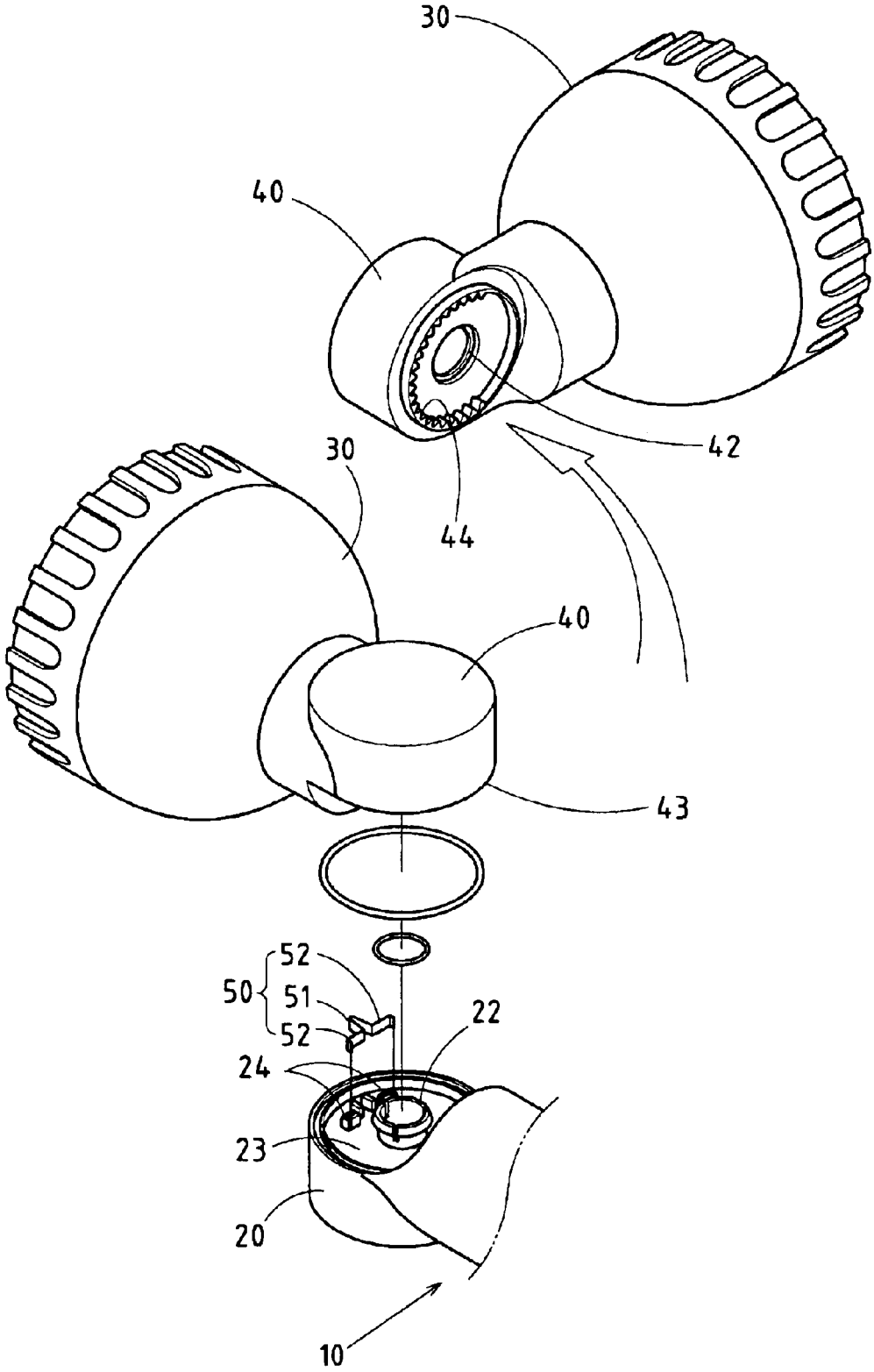
FIG. 2 shows an exploded perspective view of the revolving mechanism of the preferred embodiment of the present invention.
Figure 3:
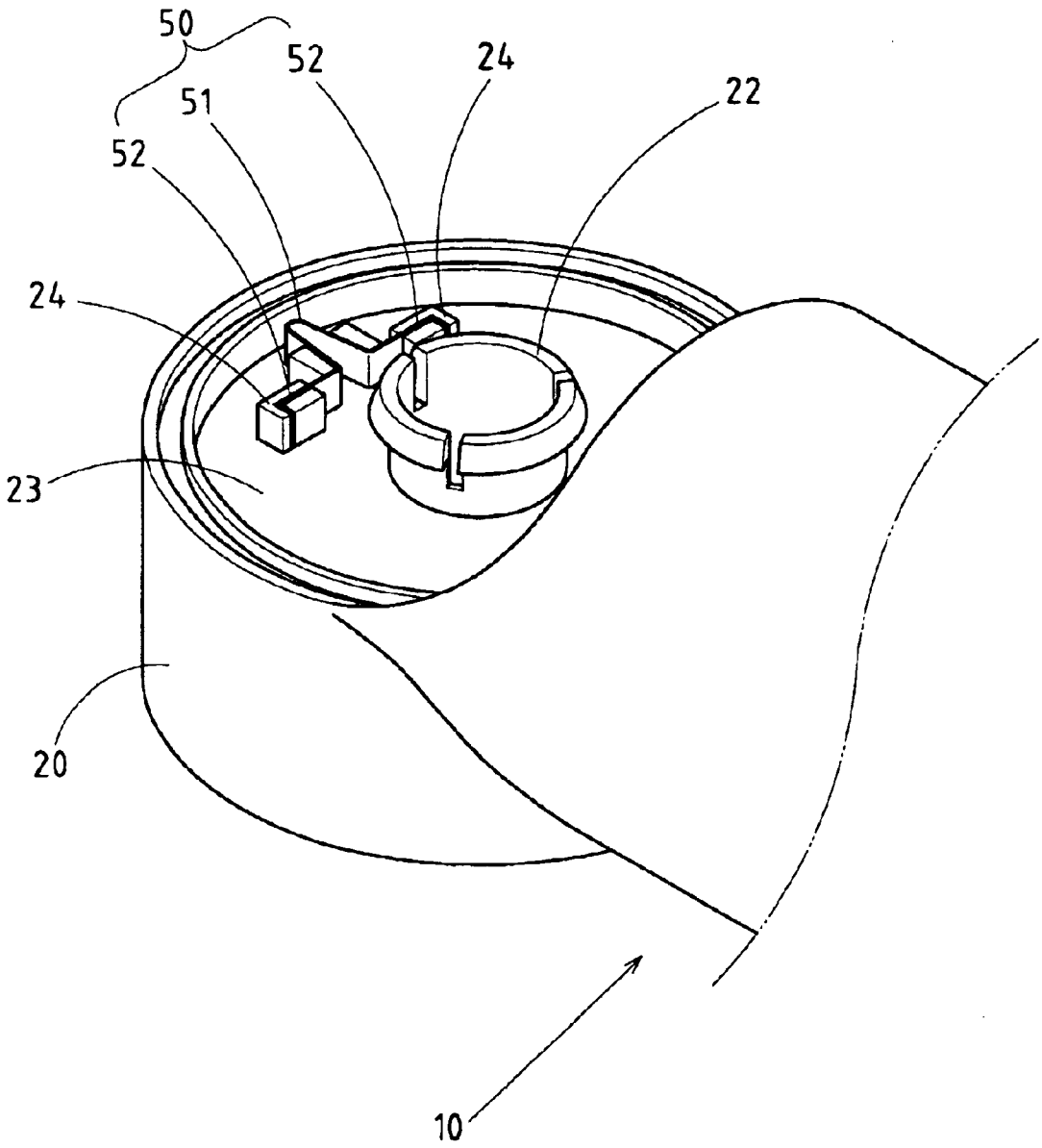
FIG. 3 shows a perspective view of the fastening end of the main body of the preferred embodiment of the present invention.

As shown in FIGS. 1–4, a gardening sprinkler embodied in the present invention comprises a main body 10, and a rotary spray head 30.

The main body 10 is provided with a grip 11, a control lever 12, and a water duct 13. The spray head 30 is provided with a number of jet nozzles 31 and is pivotally fastened with one end of the main body 10 by a revolving mechanism such that the jet nozzles 31 are in communication with the water duct 13.

Figure 4:
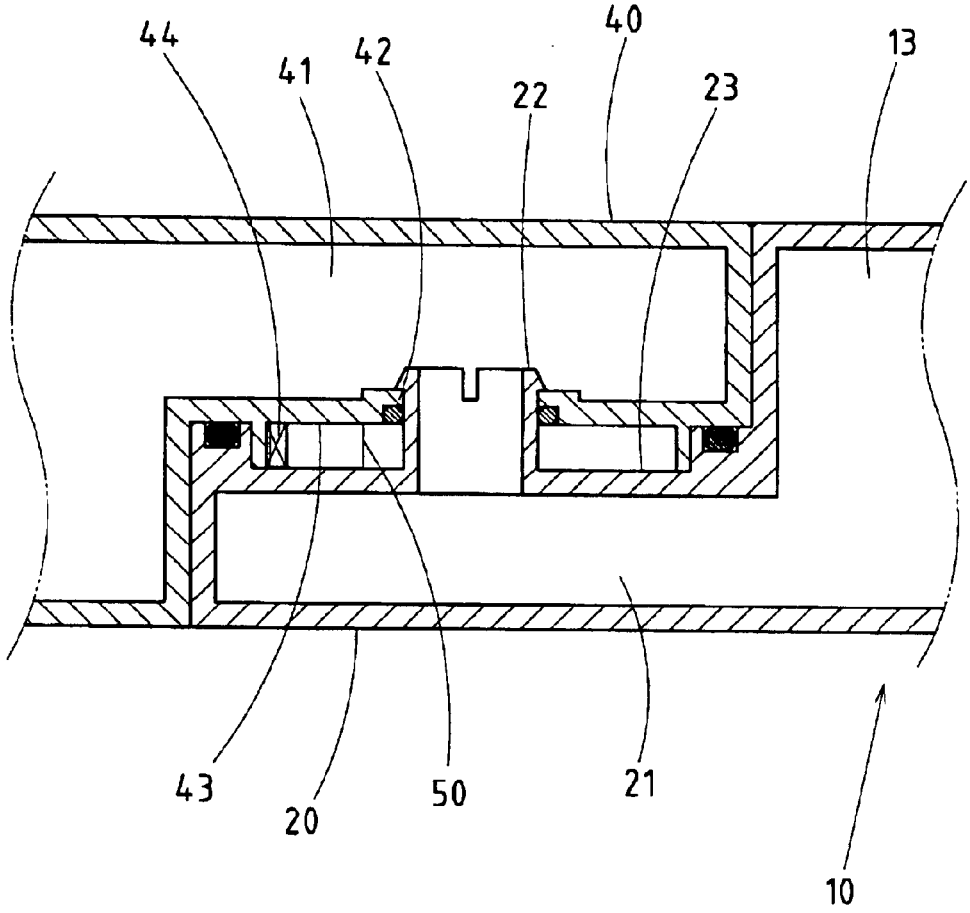
FIG. 4 shows a sectional view of the fastening end of the main body and the pivoting body of the preferred embodiment of the present invention in combination.

The revolving mechanism comprises a pivoting base 20 and a pivoting body 40. The pivoting base 20 is extended from the one end of the main body 10 and is provided in a contact face 23 with a projection 22 serving as a pivot, and two retaining pieces 24. The pivoting body 40 is provided in a contact face 43 with an arcuate rack 44 and is fastened with a connection end of the spray head 30. The pivoting body 40 is pivotally fastened with the pivoting base 20 such that a pivoting hole 42 of the pivoting body 40 is joined with the projection 22 of the base 20, with the projection 22 acting as a pivot. The contact face 43 of the pivoting body 40 comes in contact with the contact face 23 of the pivoting base 20, as shown in FIG. 4.

Figure 5:
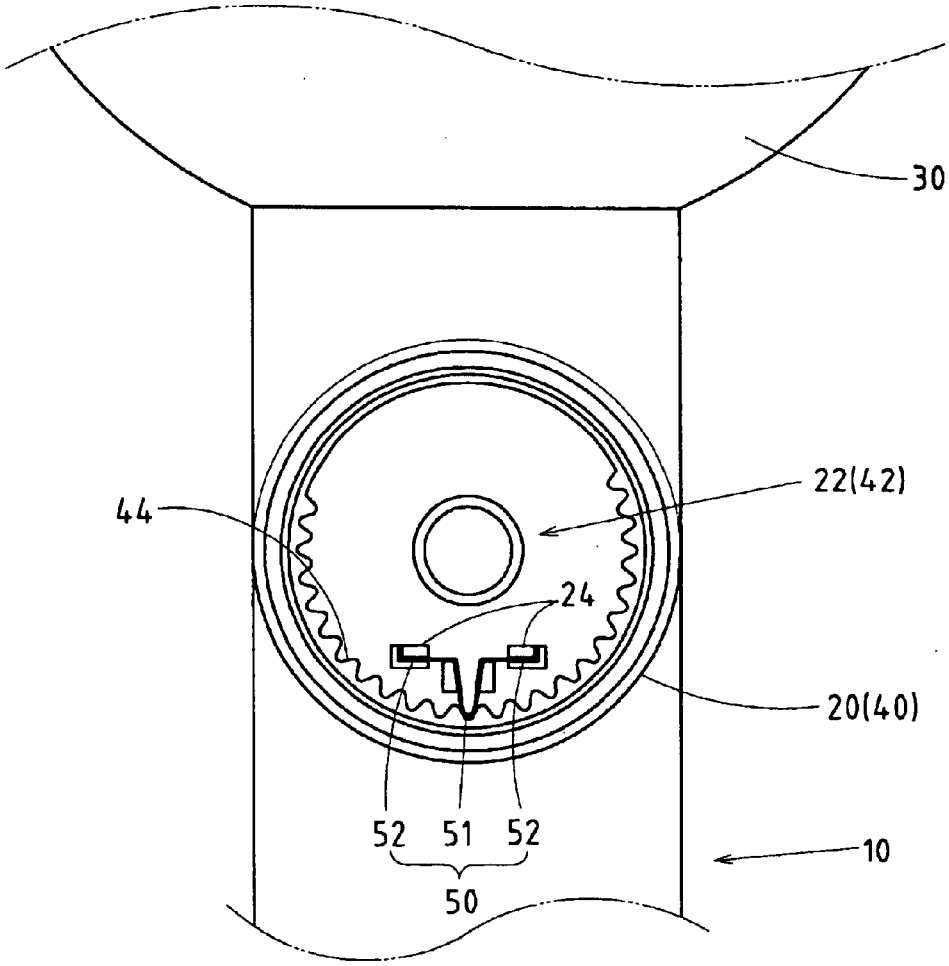
FIG. 5 is a schematic view showing that the elastic locating piece is located in one of the gullets of the arcuate rack of the pivoting body of the preferred embodiment of the present invention.
Figure 6:
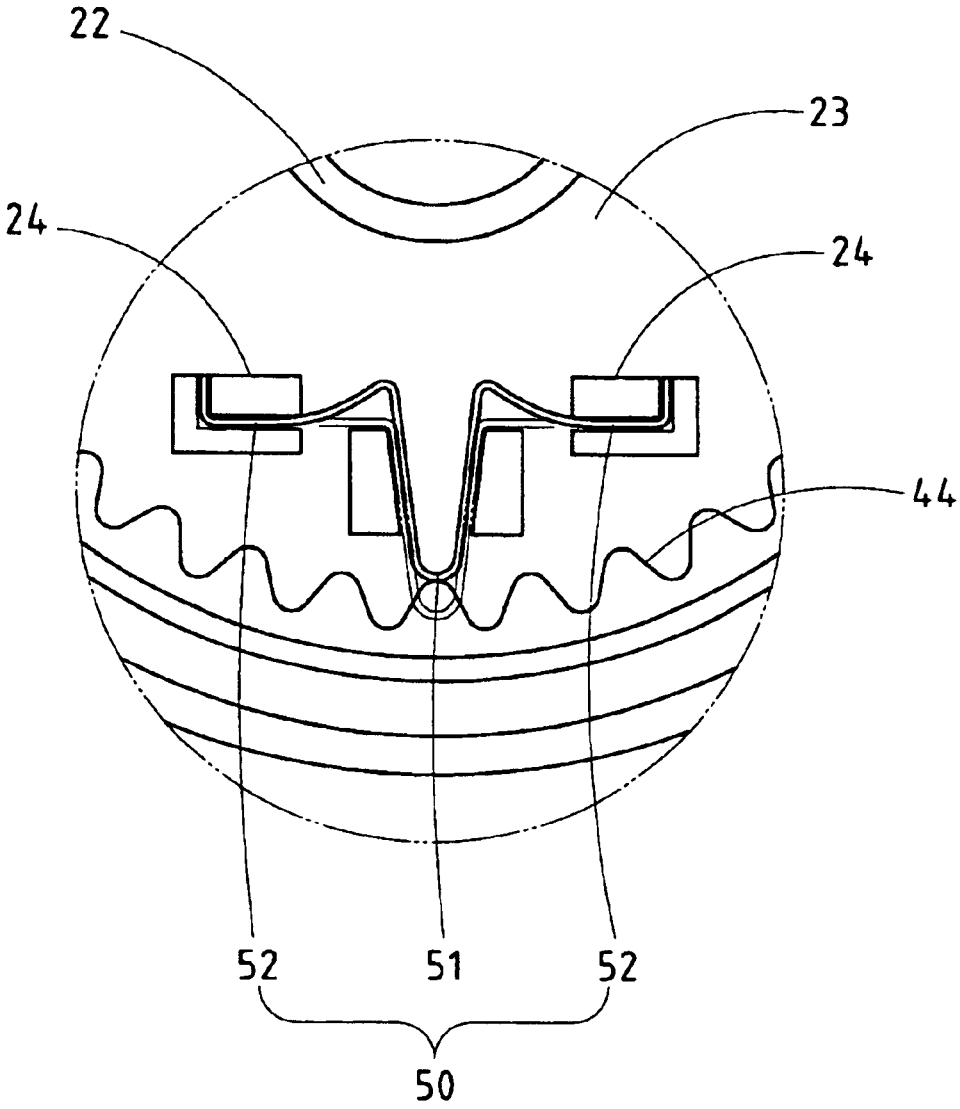
FIG. 6 is a schematic view showing that the elastic locating piece is moving past one of the points of the arcuate rack of the pivoting body of the preferred embodiment of the present invention.
Figure 7:
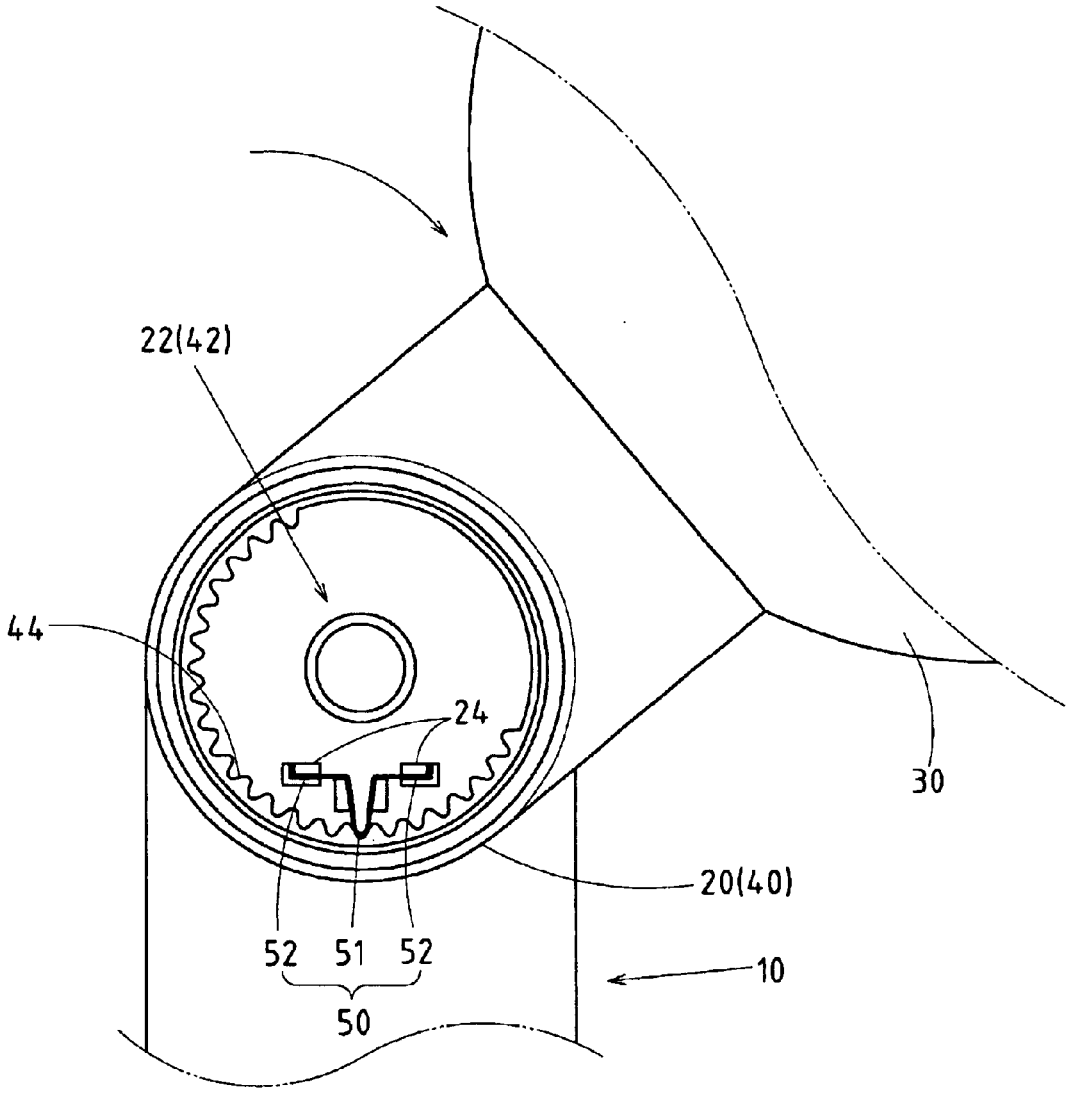
FIG. 7 shows a schematic view of the revolving mechanism of the preferred embodiment of the present invention in action.

The pivoting base 20 is provided with an elastic locating body 50, which is formed of a head 51 and two shoulders 52 extending in opposite directions from the head 51. The elastic locating body 50 is secured to the contact face 23 of the pivoting base 20 such that the two shoulders 52 of the elastic locating body 50 are securely retained by the two retaining pieces 24 of the pivoting base 20, and that the head 51 of the elastic locating body 50 is capable of plunging into one of the gullets of the rack 44 of the pivoting body 40, so as to locate the spray head 30, as illustrated in FIGS. 5 and 7. As the pivoting body 40 is turned on the projection 22 of the pivoting base 20, the head 51 of the elastic locating body 50 is caused to move from one gullet to another by moving past the point of one of the teeth of the rack 44, as illustrated in FIG. 6.

As illustrated in FIG. 7, the spray head 30 is securely located at an angular position in relation to the main body 10 by the head 51 of the elastic locating body 50, with the head 51 being securely located between two teeth of the arcuate rack 44. As a result, the spray head 30 is relatively less vulnerable to dislocation even at the time when the spray head 30 is inadvertently impacted by an external force. In addition, the elastic locating body 50 of the present invention is simple in construction and can be easily assembled. It is therefore readily apparent that the revolving mechanism of the present invention has advantages over the counterpart of the prior art.

The embodiment of the present invention described above is to be regarded in all respects as being illustrative and nonrestrictive. Accordingly, the present invention may be embodied in other specific forms without deviating from the spirit thereof The present invention is therefore to be limited only by the scope of the following claims.

I claim:

1. A gardening sprinkler comprising:

a main body; and a rotary spray head fastened to one end of said main body by a revolving mechanism;

wherein said revolving mechanism comprises:

a pivoting base extending from the one end of said main body and having a contact face whereby said contact face is provided with a projection serving as a pivot, at least one retaining piece, and an elastic locating body retained by said retaining piece; and a pivoting body fastened to a connection end of said spray head and provided in a contact face with an arcuate rack and a pivoting hole for pivoting said pivoting body to said pivoting base in such a manner that said pivoting hole of said pivoting body is joined with said projection of said pivoting base, and such that said arcuate rack is engaged with said elastic locating body of said pivoting base.

2. The gardening sprinkler as defined in claim 1, wherein said contact face of said pivoting base further comprises two retaining pieces fastened thereto at an interval; wherein said elastic locating body has a head and two shoulders extending in opposite direction from said head whereby said two shoulders are retained by said two retaining pieces such that said head is engaged with said arcuate rack of said pivoting body.

* * * * *